US005285858A

United States Patent [19]

Okada et al.

[11] Patent Number: 5,285,858

[45] Date of Patent: Feb. 15, 1994

[54] DEVICE FOR SUPPORTING IMPACT TOOL

[75] Inventors: Hiroshi Okada; Tokujiro Nakamura, both of Osaka, Japan

[73] Assignee: Nippon Pneumatic Manufacturing Co., Ltd., Osaka, Japan

[21] Appl. No.: 31,504

[22] Filed: Mar. 15, 1993

[30] Foreign Application Priority Data

Mar. 16, 1992 [JP] Japan ..... 4-058273

[51] Int. Cl.[5] ..... B25D 17/24

[52] U.S. Cl. ..... 173/211; 173/162.1; 299/37

[58] Field of Search ..... 173/210, 211, 162.1, 173/162.2; 299/37, 69, 70

[56] References Cited

U.S. PATENT DOCUMENTS 2,019,964 11/1935 Hamerly ..... 173/162.1
3,866,690 2/1975 Lance et al. ..... 299/70
4,237,987 12/1980 Sherman ..... 173/211
4,402,369 9/1983 Nikitin et al. ..... 173/162.1
4,402,383 9/1983 Bailey ..... 173/162.1
4,959,915 10/1990 Roussin et al. ..... 299/37
5,095,600 3/1992 Allan ..... 173/162.2

*Primary Examiner*—Scott Smith
*Attorney, Agent, or Firm*—Wenderoth, Lind & Ponack

[57] ABSTRACT

A shock-absorbing member is fixed to top brackets at the end of a boom opposite to the top of an impact tool. A stopper member is secured to one of the bottom of the shock-absorbing member and the top of the impact tool and the other of the same is formed with a guide recess in which the stopper member is vertically slidable. When the tip of the chisel of the impact tool is pressed hard against an object to be crushed, no turning force will be applied to vibration-damping support members which support the impact tool, thereby preventing the support members from breaking.

5 Claims, 7 Drawing Sheets

FIG. 7- PRIOR ART
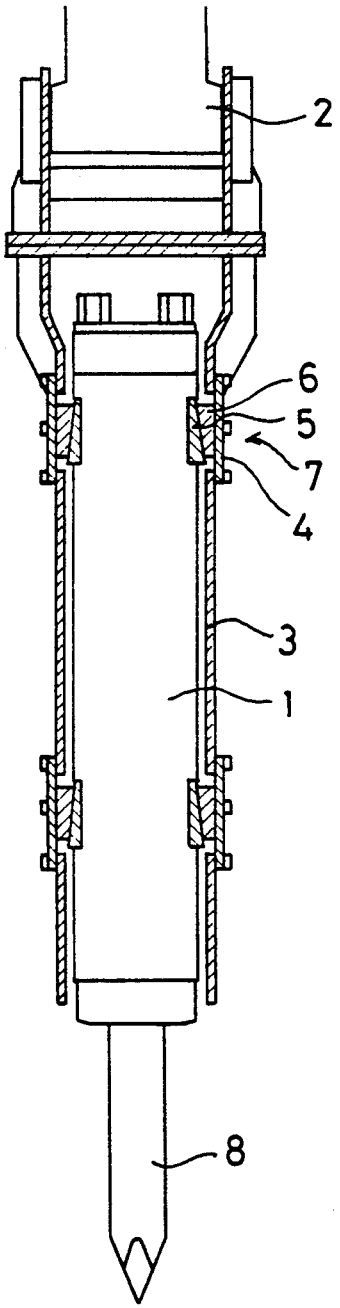

DEVICE FOR SUPPORTING IMPACT TOOL

BACKGROUND OF THE INVENTION

This invention relates to a device for supporting a hydraulic or pneumatic impact tool or breaker, used widely for crushing and demolition work at quarries and civil engineering and construction sites, on the tip of an arm of a power shovel or the like.

As shown in FIG. 1, such an impact tool 10 is mounted on the tip of an arm 2 of a self-propelled carriage 13 such as a power shovel. During use, it tends to be violently vibrated up and down. The vibration of the impact tool 10 will have a bad influence on the carriage 13 or the operator if it is transmitted directly to them.

FIG. 7 shows a prior art arrangement for preventing the vibration of the impact tool 1 from being transmitted to the carriage. In this arrangement, vibration-proof support members 7 each comprising two support fittings 4, 5 and a vibration-proof rubber member 6 sandwiched therebetween are each disposed between a respective side of an impact tool 1 and a bracket 3 having a pair of side plates and mounted on the tip of the arm 2 of a power shovel.

In order to efficiently crush rocks and concrete structures, the tip of the chisel 8 of the impact tool 1 has to be pressed hard against the object to be crushed when actuating the impact tool 1.

When the tip of the chisel 8 of the impact tool 2 is pressed hard against the object to be crushed by actuating a boom 14 and the arm 2, the vibration-proof rubber members tend to be subjected to an excessive shearing force. Especially if the axis of the impact tool 1 is not perpendicular but inclined with respect to the object to crushed as shown in FIG. 1, the impact tool 1 has a tendency to pivot in the bracket 15 about the tip of the chisel in the direction shown by arrow B. Thus, a large turning force (torsional force) always acts on the vibration-proof support members 7 supporting the impact tool 1 and the brackets 3. This will accelerate the fatigue of the vibration-proof rubber members 6 of the support members 7. Also, if the impact tool 1 is pressed hard against the object to be crushed, it may move in the direction A with respect to the brackets 3. If this happens, the vibration-proof rubber members may be broken due to a large shearing force that acts thereon.

SUMMARY OF THE INVENTION

It is therefore an object of the invention to prevent the vibration-proof support members supporting both sides of the impact tool and the brackets from being subjected to a turning force and getting broken even if the impact tool is pressed hard against an object to be crushed.

In order to solve the above problems, according to the present invention, a shock-absorbing member is secured to the bottom of top brackets mounted on the tip of an arm at a location opposite the top surface of an impact tool; a stopper member is fixed to one of the bottom of the shock-absorbing member and the top of the impact tool; and a guide recess is formed in the other of the same to guide the stopper member so as to be slidable vertically.

When the tip of the chisel of the impact tool is pressed hard against an object to be crushed by actuating the boom or arm, the impact tool is supported so as not to turn even if the axis of the impact tool is inclined with respect to an object to be crushed. This is because the impact tool is prevented from turning by the stopper member and the guide member provided on the top of the impact tool and the bottom of the top bracket. Thus, no turning force is applied to the vibration-damping support members.

Also, by the provision of the shock-absorbing member between the top of the impact tool and the bottom of the top bracket, a major part of the force that counteracts the urging force produced when the tip of the impact tool is pressed against the object to be crushed, that is, the force in the direction A will be borne by the shock-absorbing member, so that only a small stress will act on the vibration-damping support members.

According to this invention, the top end of the impact tool is held by the bottom of the top brackets. Thus, when the bottom end of the impact tool is pressed hard against an object to be crushed, the impact tool will never turn even if the axis of the impact tool is inclined with respect to the object to be crushed. When the tool is pressed hard against the object to be crushed by the power shovel, the shock-absorbing rubber member can withstand a greater biasing load, because such a load is not a shearing load but a compressive load. Since the vibration damping support members supporting both sides of the impact tool are subjected only to a small stress, they are less likely to be broken and thus can be used for a larger power shovel.

Since the vibration-damping support members are provided near the top end of the impact tool, the impact tool can be mounted to the brackets on both sides thereof through thinner spacers. The shock-absorbing member in a cylindrical or columnar form can limit the displacement of the impact tool with respect to the brackets more effectively, by damping any load that acts in a direction perpendicular to the axis of the tool due to e.g. a twisting and wrenching motion of the chisel at its tip. This serves to further increase the durability of the vibration-damping support members.

BRIEF DESCRIPTION OF THE DRAWINGS

Other features and objects of the present invention will become apparent from the following description made with reference to the accompanying drawings, in which:

FIG. 7 is a front view, partially in section, of a prior art arrangement.

DETAILED DESCRIPTION OF THE PREFERRED EMBODIMENTS

Now, the embodiments of this invention will be described.

Figure 1:
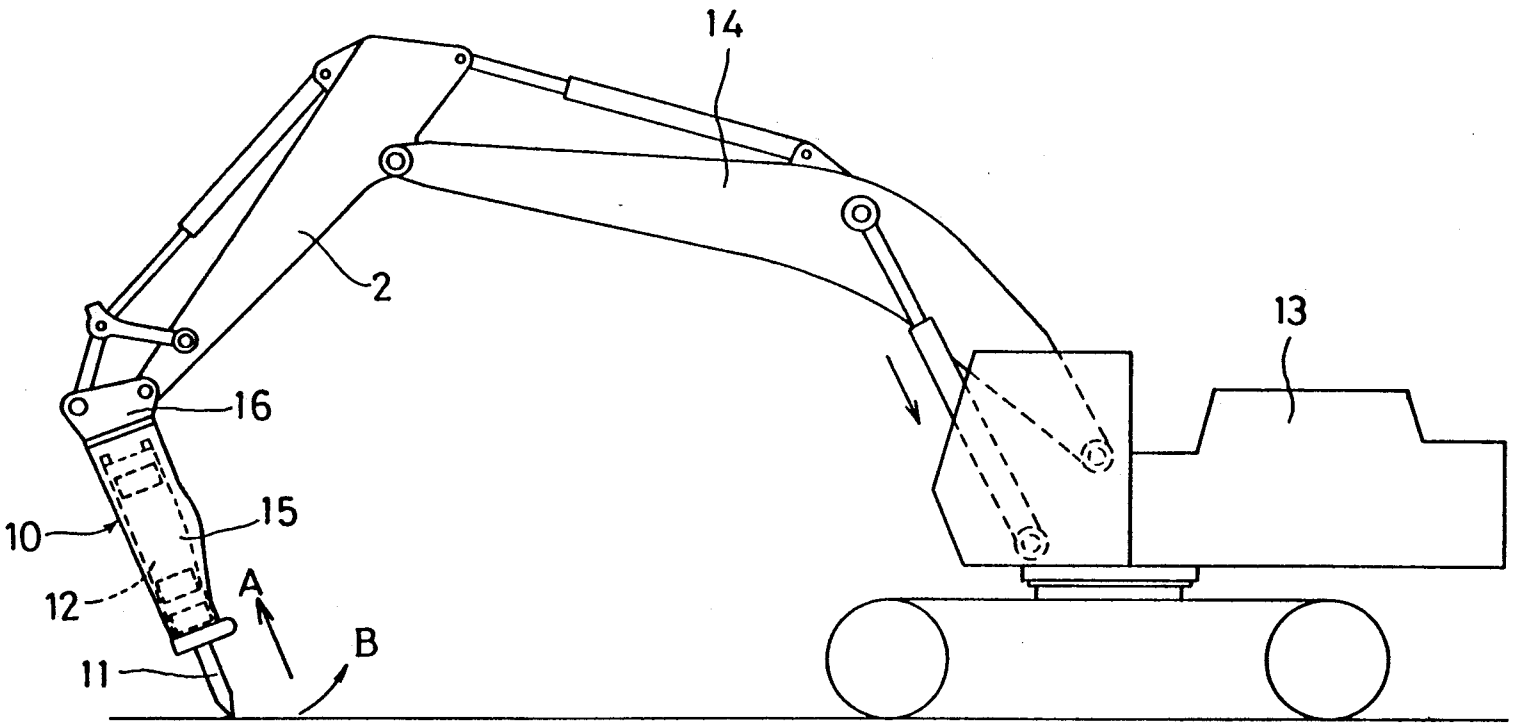
FIG. 1 is a schematic diagram of a piece of construction equipment showing how an impact tool is used.
Figure 2:
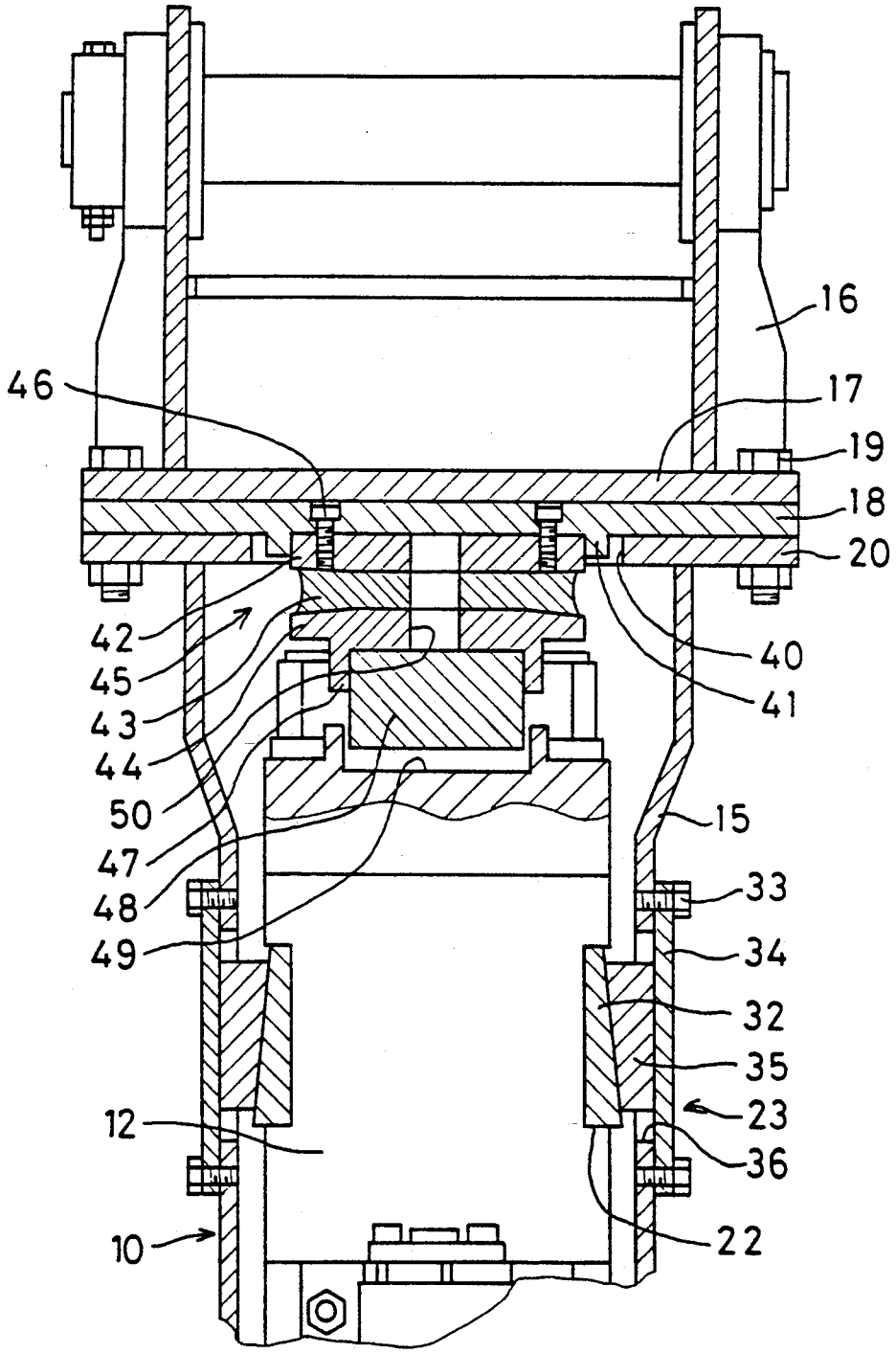
FIG. 2 is a front view, partially in section, of the upper half portion of one embodiment of the present invention.

Referring to FIGS. 1 and 2, an impact tool 10 comprises a chisel 11 and a tool body 12. The tool 10 is supported on brackets 15 mounted on a tip of an arm 2 of a self-propelled carriage 13 such as a power shovel.

The brackets 15 oppose each other with the tool body 12 sandwiched therebetween and have on top ends thereof a mounting plate 20 secured by bolts 19 through a spacer 18 to a bottom plate 17 of top brackets 16 mounted on the tip of the arm 2.

Figure 3:
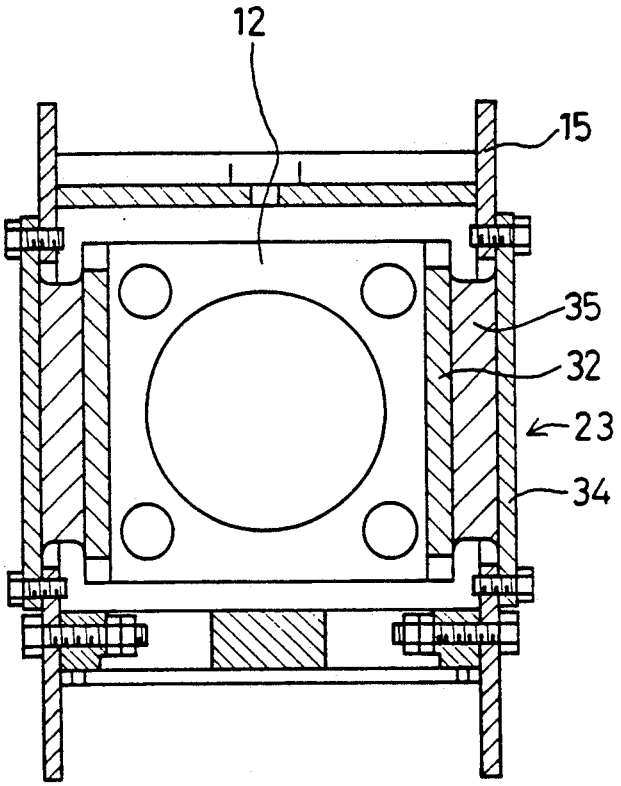
FIG. 3 is a cross-sectional view of the same.

FIGS. 2 and 3 show the first embodiment in which vibration-proof support members 23 each comprises a support fitting 32 inserted in a corresponding support recess 22 in the impact tool body 12, a fixed plate 34 fixed to the corresponding bracket 15 by means of bolts 33, and a rubber plate 35 interposed between the fitting 32 and the fixed plate 34. In this embodiment, the rubber plates 35 are received in through-holes 36 formed in the brackets 15. The rubber plates 35 are thus subjected to shearing forces.

Figure 4:
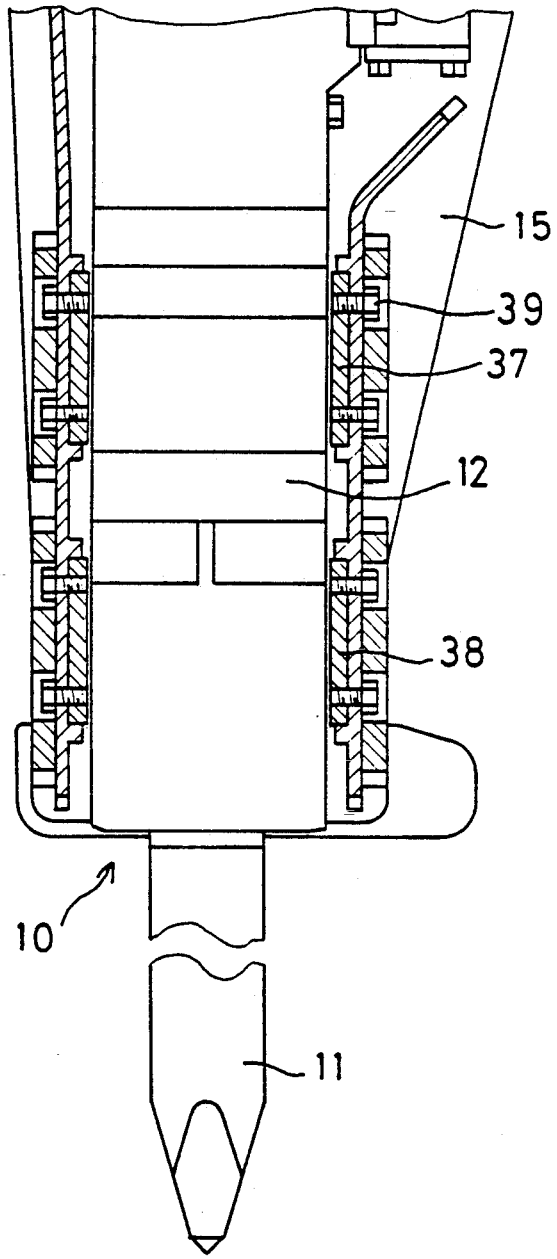
FIG. 4 is a side view, partially in section, of a lower half portion of the present invention.

Referring to FIG. 4, upper and lower spacers 37 and 38 are secured to the front and rear surfaces of the brackets 15 at their lower portions by means of bolts 39, with predetermined gaps left between the spacers 37, 38 and the front and rear surfaces of the impact tool body 12 to permit sliding movement of the tool body in only a vertical direction. The spacers 37 and 38 are formed of a hard resin such as hard nylon or quenched iron plate.

An annular rib 41 is formed on the bottom surface of the spacer 18 mounted on the bottom plate 17 of the top brackets 16. The rib 41 is received in a through-hole 40 formed in the mounting plate 20. Inside the annular rib 41, a shock-absorbing member 45 is fitted which comprises a fixing plate 42, a shock-absorbing rubber member 43 and a backing plate 44, which are laminated one on another. The fixing plate 42 is fixed to the spacer 18 by means of bolts 46. The fixing plate 42 and the backing plate 44 of the shock-absorbing member 45 are made of steel.

The backing plate 44 is integrally provided on the bottom surface thereof with a mounting frame 47 which carries a stopper member 48 made of a hard resin such as hard nylon. The lower portion of the stopper member 48 protrudes downwards from the mounting frame 47 and is received in a guide recess 49 formed in the top surface of the impact tool body 12.

In order that the stopper member 48 is slidable vertically, it is kept apart a slight distance from the surface defining the side of the guide recess 49 in a direction perpendicular to the longitudinal axis of the tool body. Between the bottom end face of the stopper member 48 and the surface defining the bottom of the guide recess 49, a predetermined space is defined.

The shock-absorbing member is formed with a hole 50 that extends through the fixing plate 42, shock-absorbing rubber member 43 and backing plate 44. This increases the damping effect. When the stopper member 48 gets worn out, it can be pushed out through the hole 50.

Figure 5:
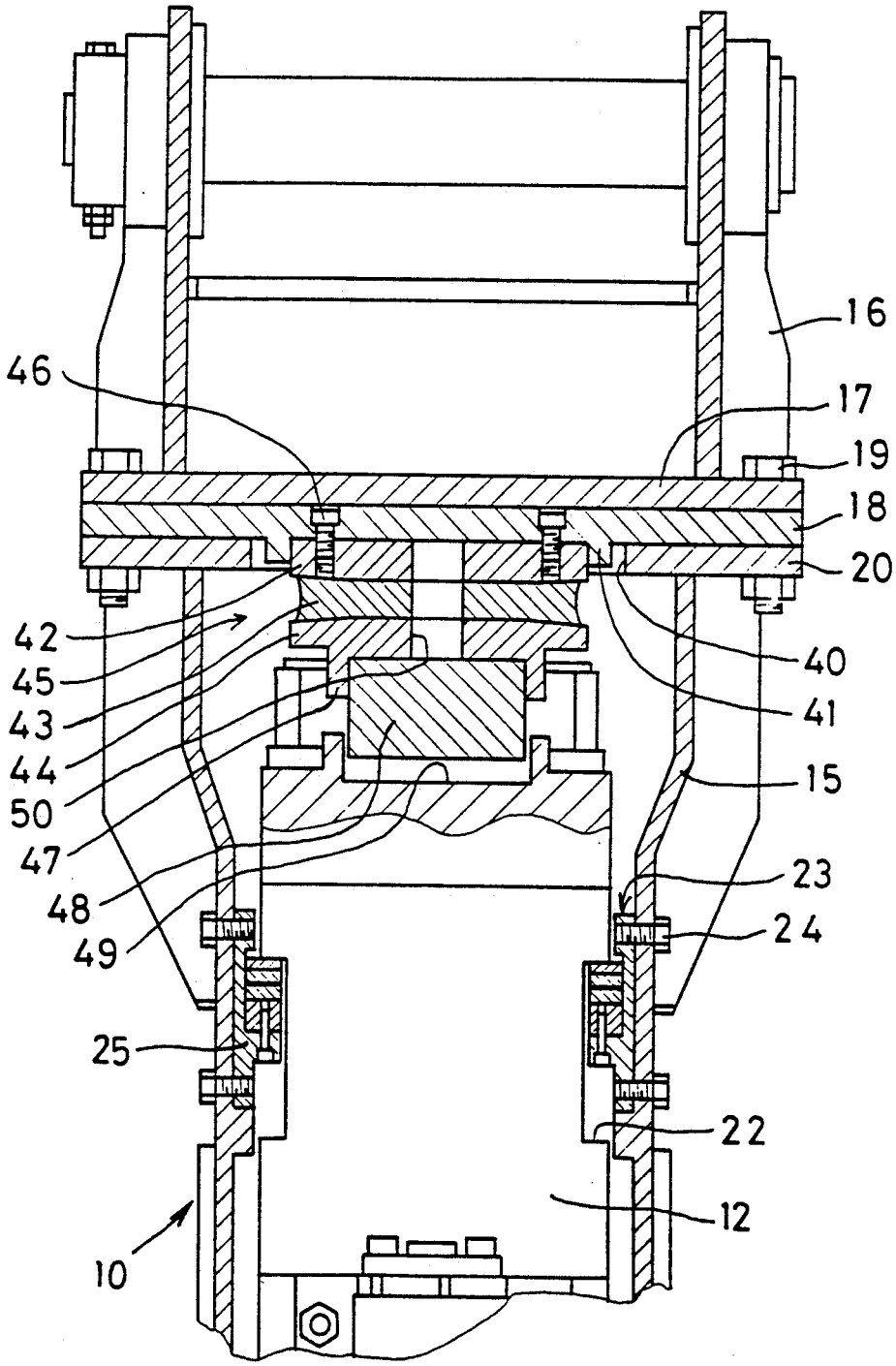
FIG. 5 is a front view, partially in section, of the upper half portion of another embodiment of the present invention.
Figure 6:
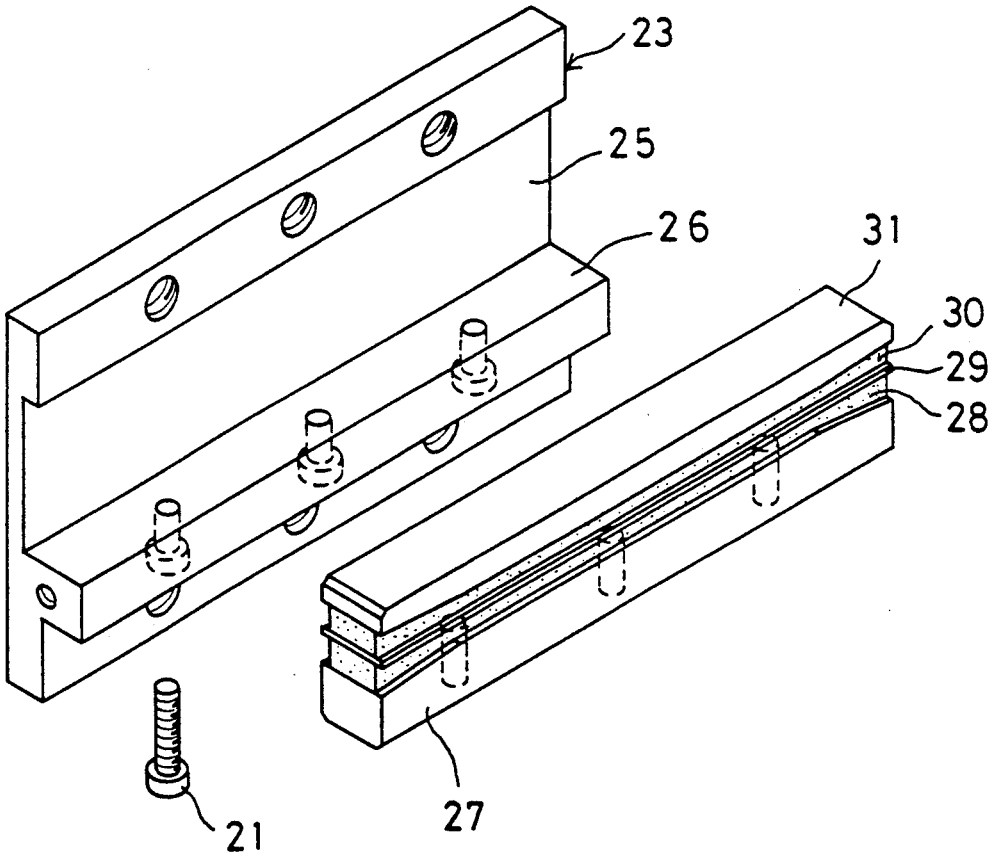
FIG. 6 is an exploded perspective view of a vibration-damping support member of the same.

In the second embodiment shown in FIGS. 5 and 6, vibration-proof support member 23 are secured to the opposed surfaces of the bracket 15 near their top ends by means of bolts 24 and are fitted in support recesses 22 formed in side faces of the impact tool body 12.

As shown in FIG. 6, each vibration–damping support member 23 comprises a fixing plate 25 adapted to be fixed to the bracket 15 by bolts 24 and provided on the inner portion thereof with a ledge 26, a lower metal plate 27 secured to the top surface of the ledge 26 by means of bolts 21, a rubber plate 28 provided on the top surface of the lower metal plate 27, a thin metal plate 29 provided further thereon, a rubber plate 30 provided further thereon and an upper metal plate 31 provided further thereon. The top surface of the upper metal plate 31 is adapted to engage the top wall of the support recess 22 of the impact tool body 12. The impact tool body 12 is supported on the bracket 15 through the vibration–damping support members 23 inserted in the corresponding support recesses 22 of the impact tool body 12. In this state, a predetermined space is defined between the bottom surface of the ledge 26 of each fixed plate 25 and the surface defining the bottom of the corresponding support recess 22.

Since the rubber plates 28 and 30 of the vibration-damping support members are subjected to compressive force, they have to be made of a load-resistant material.

The above-mentioned space between the stopper member 48 and the surface defining the bottom of guide recess 49 is narrower than the space between the surface defining the bottom of the ledge 26 of each vibration-proof support member 23 and the wall defining the bottom of the corresponding support recess 22. Thus, by pressing the tip of the chisel 11 of the impact tool 10 against an object to be crushed, the top surface of the impact tool 10 abuts the bottom end face of the stopper member 48, thus compressing the shock-absorbing member 45.

In the above embodiments, the stopper member 48 is a fixed part of the shock-absorbing member 45. But the stopper member 48 may be secured to the impact tool body 12. In this case, the guide recess 49 is formed in the shock-absorbing member 45. Preferably, the shock-absorbing member 45 and the guide recess should be cylindrical and the stopper member 48 should have the shape of a column.

While the force in the direction A (FIG. 1) is small, the vibration–damping support member 23 mainly acts to damp vibration.

What is claimed is:

1. The combination of an impact tool and support structure supporting the impact tool on a tip of an arm of a piece of construction equipment, wherein said impact tool has an outermost casing from which vibrations produced by the impact tool propagate, said outermost casing having a top portion and a recess in the exterior of said top portion, and said support structure includes lower brackets mounted to the tip of said arm, vibration-damping support members interposed between the outermost casing of said impact tool and said lower brackets so as to damp the vibrations propagating from the outermost casing of said impact tool, top brackets mounted to the tip of said arm, a shock-absorbing member secured to a bottom portion of said top brackets at a location opposing said top portion of the outermost casing of said impact tool, said shock-absorbing member having a bottom facing the top portion of the outermost casing of said impact tool, and a stopper member fixed to one of the bottom of said shock-absorbing member and the top portion of the outermost casing of said impact tool, the other of the bottom of said shock-absorbing member and the top portion of the outermost casing of said impact tool having a guide recess therein freely receiving said stopper member such that the impact tool is slidable over a limited distance relative to said shock-absorbing member in an axial direction of said casing of the impact tool, whereby said stopper member and said shock-absorbing member protect said vibration-damping support members from excessive forces which act on the impact tool supported on said lower brackets by the vibration-damping members.

2. The combination of an impact tool and support structure supporting the impact tool as claimed in claim 1, wherein said vibration-damping support members are located at an upper portion of said impact tool, and said impact tool has a lower portion located within and spaced from said lower brackets.

3. The combination of an impact tool and support structure supporting the impact tool as claimed in claim 1, wherein said stopper member comprises a hard resin.

4. The combination of an impact tool and support structure supporting the impact tool as claimed in claim 1, wherein said shock-absorbing member and said stopper member are columnar.

5. The combination of an impact tool and support structure supporting the impact tool as claimed in claim 1, wherein said other of the bottom of said shock-absorbing member and the top portion of said outermost casing has an annular ring extending around a portion of said stopper member, said annular ring defining said guide recess.

* * * * *